US006186080B1

(12) United States Patent
Hino et al.

(10) Patent No.: US 6,186,080 B1
(45) **Date of Patent: *Feb. 13, 2001**

(54) RECOVERY BOILER

(75) Inventors: Hirokazu Hino; Toshimitsu Ichinose; Kimishiro Tokuda, all of Nagasaki; Yoshihisa Arakawa; Masaaki Nagai, both of Tokyo; Yoshitaka Baba, Nagasaki, all of (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/965,530

(22) Filed: Nov. 6, 1997

(30) Foreign Application Priority Data

Nov. 22, 1996 (JP) ..... 8-311996

(51) Int. Cl.[7] ..... D21C 11/12; F23L 9/00

(52) U.S. Cl. ..... 110/238; 110/206; 110/214; 110/297; 110/234; 431/10; 162/31

(58) Field of Search ..... 110/238, 203, 110/204, 210, 213, 214, 260, 262, 297, 301, 309, 313, 345, 348, 205, 206, 343, 346, 233, 234, 182.5; 431/76, 10, 164, 165; 162/1, 29, 30.1, 30.11, 31; 422/129, 185

(56) References Cited

U.S. PATENT DOCUMENTS

| | | | | |
|---|---|---|---|---|
| 3,215,099 | * | 11/1965 | Coulter, Jr. | 110/238 |
| 3,421,462 | * | 1/1969 | Wessberg | 110/238 |
| 3,748,081 | * | 7/1973 | Hummell | 110/238 X |
| 4,359,950 | * | 11/1982 | Leffler et al. | 431/76 X |
| 4,403,941 | * | 9/1983 | Okiura et al. | 431/10 |
| 5,007,354 | * | 4/1991 | Uppstu | 110/297 X |
| 5,121,700 | * | 6/1992 | Blackwell et al. | 110/348 |
| 5,450,803 | * | 9/1995 | Svensk et al. | 110/238 X |
| 5,478,440 | * | 12/1995 | Paju | 110/238 X |
| 5,709,173 | * | 1/1998 | Ahtila et al. | 122/1 C |
| 5,715,763 | * | 2/1998 | Fornetti et al. | 110/238 |
| 5,724,895 | * | 3/1998 | Uppstu | 110/238 |
| 5,771,817 | * | 6/1998 | Olausson et al. | 110/238 |

FOREIGN PATENT DOCUMENTS

| | | | |
|---|---|---|---|
| 54-46901 | | 4/1979 | (JP) . |
| 54-55603 | | 5/1979 | (JP) . |
| 55-107826 | | 8/1980 | (JP) . |
| 57-142415 | * | 9/1982 | (JP) ..... 110/238 |
| 63-286602 | | 11/1988 | (JP) . |
| 2-106495 | | 8/1990 | (JP) . |

* cited by examiner

*Primary Examiner*—Ira S. Lazarus
*Assistant Examiner*—Ljiljana V. Ciric
(74) *Attorney, Agent, or Firm*—Wenderoth, Lind & Ponack, L.L.P.

(57) ABSTRACT

A boiler recovers a soda component from pulp spent liquor and is able to prevent carry-over of unburnt char and deformation of a char bed configuration and to attain a stable combustion with low $NO_x$ generation. By regulating the combustion air supply, and feeding inert gas along a furnace side wall around the char bed, there are formed a combustion zone of reduction atmospheric field where air ratio in the surroundings of the char bed is 0.8 or less, a combustion zone of reduction atmospheric field where air ratio is 1.0 or less and unburnt components exist (including the case of a reduction atmospheric field where air ratio is 1.0 or less and unburnt components exist with the two combustion zones being combined together) and a combustion zone where combustion is completed.

2 Claims, 5 Drawing Sheets

RECOVERY BOILER

BACKGROUND OF THE INVENTION

1. Field of the Invention

The present invention relates to a recovery boiler for recovering a soda component etc. from pulp spent liquor etc.

2. Description of the Prior Art

In a pulp spent liquor generated in a paper making process, there are contained, in a large quantity, a portion of organic matter of wood materials and a soda component added in the process of cooking. The spent liquor (hereinafter referred to as "black liquor") is once condensed and then burnt in a recovery boiler comprising a furnace. A main object is to recover the soda component so that the soda component in the black liquor is recovered as a sodium carbonate and a sodium sulfide in a molten state.

FIG. 8 is a schematic view showing a recovery boiler in the prior art. A black liquor 42*a* is ejected from a plurality of black liquor burners 42 into a recovery boiler 41. On the other hand, a combustion air 40 is fed thereinto from a primary air nozzle 45*a,* a secondary air nozzle 45*b* and a tertiary air nozzle 45*c* via a fan 43 and air dampers 44*a,* 44*b* and 44*c.* The black liquor 42*a* is burned on a char bed 46 formed at a lower portion of the boiler.

In the recovery boiler 41, the black liquor 42*a,* containing comparatively coarse particle sizes, is ejected from the black liquor burners 42 to a mid portion of the furnace, as shown by dotted line arrows in FIG. 8. The liquor 42*a* falls while it is being dried by a furnace combustion gas and is then accumulated on a furnace floor so as to form the char bed 46 to be burned.

With the enhancement of evaporator performance to condense the water content from spent liquor, it is a recent tendency that a solid concentration in the black liquor 42*a,* which had so far been 60%, has been increased to 80%. The result is that boiler combustion efficiency has been increased, and also the concentration of the black liquor itself is enhanced.

Also, a sufficient quantity of the primary air, the secondary air and the tertiary air is being fed to the surroundings of the char bed 46 and the degree of combustion of the black liquor 42*a* on the char bed 46 is enhanced, which results in a combustion state causing a sharp rise of nitrogen oxides (hereinafter referred to as "$NO_x$"), an object of pollution control regulations. Thus in order to operate the recovery boiler in accordance with pollution control regulations, it is indispensable to reduce the quantity of $NO_x$ discharged from the furnace outlet.

One method for reducing the $NO_x$ considered is to generate a combustion zone of a reduction atmospheric field in which the air ratio in the surroundings of the char bed is 0.8 or less and to feed additional air from an upper portion of the furnace. In this case, however, a quantity of all or any of the primary air, the secondary air and the tertiary air is necessarily reduced, the flow velocity of air fed into the furnace is lowered, and the air quantity distribution in the furnace becomes irregular, so that there occurs a non-uniform combustion, a carry-over of unburnt char, a deformation of the char bed, etc. This makes the holding of stable combustion difficult.

SUMMARY OF THE INVENTION

In view of the problems in the prior art, it is an object of the present invention to provide a recovery boiler which is able to effect a $NO_x$ reduction securely.

In order to attain the object, the present invention provides a recovery boiler comprising a burner for ejecting a black liquor into a furnace and a combustion air supply system, wherein the combustion air supply system consists of a main air supply for feeding air so as to form a reduction atmospheric field where an air ratio in the surroundings of a char bed formed on a furnace bottom is 0.8 or less. A first additional air nozzle is disposed downstream of the main air supply for feeding air so as to form a reduction atmospheric field where an air ratio is 1.0 or less and unburnt components exist. A second additional air nozzle is disposed downstream of the first additional air nozzle for feeding a shortage of air so as to form a combustion zone where combustion completes. The recovery boiler further comprises a means for feeding a recirculated gas or an inert gas together with a combustion air and/or along a furnace side wall around the char bed. There are thereby sequentially formed a combustion zone of the reduction atmospheric field of an air ratio of 0.8 or less formed by the main air supply, a combustion zone of the reduction atmospheric field of an air ratio of 1.0 or less formed by the first additional air nozzle and a combustion zone for completing the combustion formed by the second additional air nozzle. A combustion with a reduced quantity of $NO_x$ generation is thereby attained.

Moreover, a recirculated gas or an inert gas is fed along the furnace side wall around the char bed so as to form a pneumatic curtain. The furnace side wall including side wall pipings is thereby prevented from being corroded by sulfide generated from a sulfur component in the black liquor at the combustion zone of the reduction atmospheric field.

Also, the present invention provides a recovery boiler comprising a burner for ejecting a black liquor into a furnace and a combustion air supply system, wherein the combustion air supply system consists of a main air supply for feeding air so as to form an air ratio in the surroundings of a char bed formed on a furnace bottom of 0.8 or less and an additional air nozzle disposed downstream of the main air supply for feeding a shortage of air. The main air supply consists of a primary air nozzle for feeding air toward between the char bed and the furnace bottom, a secondary air nozzle for feeding air toward an inclined side face of the char bed and a tertiary air nozzle for feeding air downwardly toward a furnace side from an upper portion of the char bed and directed in a direction generating a swirling force from a furnace side wall or a furnace corner. The char bed is thereby prevented from coming nearer to the furnace side wall by the primary air nozzle so that the char bed configuration becomes stabilized. The air distribution in the furnace is homogenized by the secondary air nozzle and the unburnt char which is liable to be carried over is suppressed so as not to be carried over to the furnace upper portion. A stable combustion is thus attained.

Also, the present invention provides a recovery boiler as mentioned immediately above, wherein the primary air nozzle feeds air at an air flow velocity of 30 m/s or more and the secondary air nozzle at an air flow velocity of 50 m/s or more, each with an air quantity of 40% or less of an entire combustion air, and the tertiary air nozzle feeds a shortage of air. The stabilization of the char bed configuration, homogenization of the air distribution in the furnace and carry-over of the unburnt char are thereby attained further accurately and securely and a stable combustion is further accelerated.

Also, the present invention provides a recovery boiler comprising a burner for ejecting a black liquor into a furnace and a combustion air supply system, wherein the combustion air supply system consists of a main air supply for feeding air so as to form a reduction atmospheric field where an air ratio in the surroundings of a char bed formed on a furnace bottom is 0.8 or less. A first additional air nozzle is disposed downstream of the main air nozzle for feeding air so as to form a reduction atmospheric field where an air ratio is 1.0 or less and unburnt components exist. A second additional air nozzle is disposed downstream of the first additional air nozzle for feeding a shortage of air so as to form a combustion zone where combustion completes. The combustion air supplied from the main air supply thereby forms the reduction atmospheric field of an air ratio of 0.8 or less, and even if the additional combustion air is added downstream thereof from the first additional air nozzle, the reduction atmospheric field is maintained with its air ratio of 1.0 or less, and then the shortage of the combustion air is supplied further downstream thereof from the second additional air nozzle so that the combustion of the unburnt components completes. Thus a low $NO_x$ combustion is attained.

Also, the present invention provides a recovery boiler comprising a burner for ejecting a black liquor into a furnace and a combustion air supply system, wherein the combustion air supply system consists of a main air supply and a first additional air nozzle for feeding air so as to form a reduction atmospheric field where an air ratio in the surroundings of a char bed formed on a furnace bottom is 1.0 or less and a second additional air nozzle disposed in plural steps and/or in plural pieces downstream of the first additional air nozzle for feeding a shortage of air so as to form a combustion zone where combustion completes. Unburnt components generated at the reduction atmospheric field of an air ratio of 1.0 or less formed by a combustion air from the main air supply and the first additional air nozzle are burned completely by the air from the second additional air nozzle. As one example, combustion air is thereby fed from the main air supply consisting of primary and secondary air nozzles and from the first additional air nozzle consisting of a tertiary air nozzle so as to effect a reduction combustion in the reduction atmospheric field where the air ratio in the surroundings of the char bed is 1.0 or less, for example 0.8 or less, and an additional combustion air is fed further downstream thereof from the second additional air nozzle, consisting of a quaternary air nozzle for example, disposed in plural steps and/or plural pieces, so that the unburnt components generated in the reduction atmospheric field in the surroundings of the char bed are completely burned. Thus, such a reduction atmospheric field and a combustion completion field are formed with the aim that the $NO_x$ generated by the reduction combustion reaction is converted into $N_2$ and the unburnt components generated are burned completely and finally, and a stable combustion with a reduced $NO_x$ quantity and without unburnt components can be attained.

DESCRIPTION OF THE PREFERRED EMBODIMENTS

Figure 1:
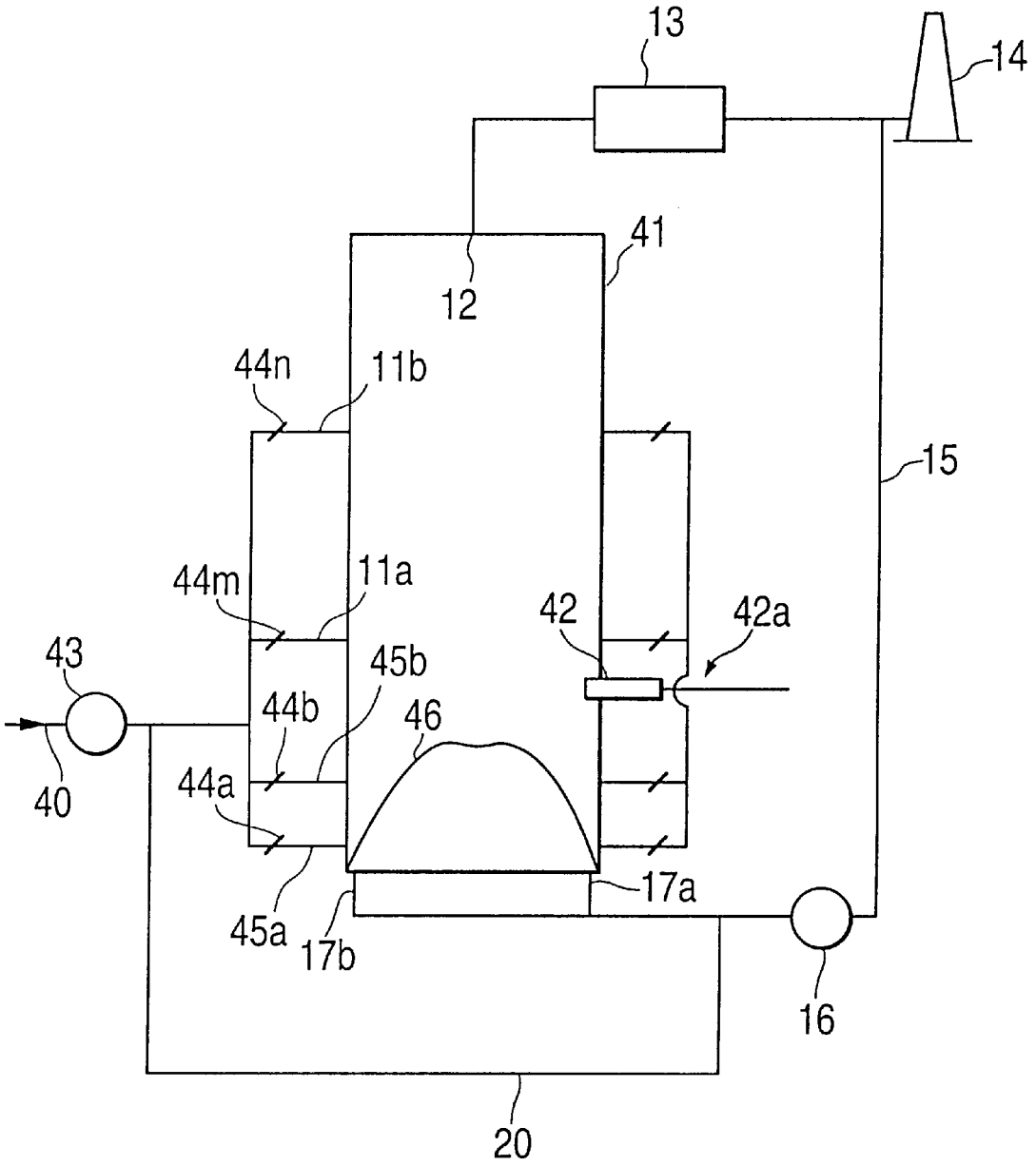
FIG. 1 is a schematic view of a recovery boiler of a first embodiment according to the present invention.

With reference to FIG. 1, a first embodiment according to the present invention is described. The same parts as those in the prior art are given the same numerals and repeated description is omitted.

In FIG. 1, numeral 43 designates a fan for regulating all the air supply for a combustion air supply system. Combustion air from the fan 43 is fed into a furnace from a primary air nozzle 45*a* and a secondary air nozzle 45*b* via air dampers 44*a* and 44*b* disposed directedly from upstream to downstream with its air ratio in the surroundings of a char bed being adjusted to 0.8 or less. The primary air nozzle 45*a* and secondary air nozzle 45*b* constitute a main air supply of the combustion air supply system.

Likewise, via an air damper 44*m,* air is fed from a first additional air nozzle 11*a,* with it air ratio being adjusted to 1.0 or less, and further via an air damper 44*n,* a shortage of air being fed from a second additional air nozzle 11*b.* It is to be noted that an optimum position of the first and second additional air nozzles 11*a,* 11*b* respectively, is decided depending on a residence time of a furnace combustion gas, and the number of positions is not limited to two stages, but may be other plural stages. The additional air nozzles 11*a* and 11*b* also form part of the combustion air supply system.

Also, while an optimum air blowing velocity and direction of the first and the second additional air nozzles 11*a,* 11*b* respectively, are selected depending on a state of combustion or a state of combustion exhaust gas flow, it is satisfactory if the arrangement is such that the air that is supplied reaches a furnace center and is diffused and mixed uniformly in the furnace.

By so feeding the combustion air as described above, there can be formed a combustion zone of reduction atmospheric field in which an air ratio in the surroundings of the char bed 46 is 0.8 or less, a combustion zone at an upper portion thereof of reduction atmospheric field in which an air ratio is 1.0 or less and unburnt components exist, and a combustion zone at a further upper portion thereof in which the combustion completes. Thus $NO_x$ generation can be sufficiently reduced.

In each combustion zone, a reaction takes place as follows: that is, in the combustion zone of reduction atmospheric field in which the air ratio is 0.8 or less, there exists surplus fuel beyond a chemical equivalent of oxygen, and a portion of the fuel forms a reduction atmospheric field which burns in a high temperature combustion atmosphere, thus fuel and a nitrogen (N) component in a black liquor and a nitrogen component in the air present reactions of:

$$C_nH_n+CO_2 \rightarrow CO_2+H_2O \quad N+O_2 \rightarrow NO, \qquad \text{(Chemical equations 1)}$$

and then in the combustion zone of reduction atmospheric field in which unburnt components exist, the following reactions occur:

$$C_nH_n+O_2 \rightarrow H_2+CO+C_n'H_m'C_n'H_m'+NO \rightarrow NHi+N_2+ C_n''H_m'', \qquad \text{(Chemical equations 2)}$$

where the symbols of a single comma "," or double commas "," designate activated hydrocarbon radicals.

Further, in the combustion zone of combustion completion field, the following reactions occur:

$$C_n''H_m''+O_2 \rightarrow CO_2+H_2O \quad C_n'H_m'+O_2 \rightarrow CO_2+H_2O \quad CO+H_2+O_2 \rightarrow CO_2+H_2O \quad NHi+O_2 \rightarrow NO+N_2O \text{ or } NHi+O_2 \rightarrow N_2+H_2O, \qquad \text{(Chemical equations 3)}$$

and thus $NO_x$ reduction can be attained.

It is to be noted that a combustion gas 12 to be discharged from a recovery boiler 41 is partially extracted by a fan 16 via an extraction duct 15 from a passage of the combustion gas between a heat exchanger 13 and a stack 14 for gas discharge into the air and is ejected from nozzles 17*a* and 17*b* into a furnace lower portion along a furnace side wall including side wall pipings around the char bed. Thus, a pneumatic curtain is formed along the furnace side wall by the exhaust gas so extracted and fed into the furnace again so that direct contact of sulfide and the furnace side wall is avoided, and corrosion of the furnace side wall can thereby be prevented.

Also, to be noted is that the nozzles 17*a,* 17*b* are provided in a plural number of pieces, and while an optimum ejection direction and velocity of the extracted gas are naturally decided corresponding to a recovery boiler configuration, a char bed configuration or a combustion state, it is satisfactory if the extracted gas may go up along the furnace side wall and directly contact the sulfide, etc., and the furnace side wall may be avoided. Also, the avoidance of corrosion of the furnace side wall is applicable within the recovery boiler, and not limited to the reduction atmospheric field therein.

Further, there can also be added an arrangement in which an inert gas such as a recirculated gas etc. is fed into the combustion air via the fan 16 and a duct 20.

Figure 2:
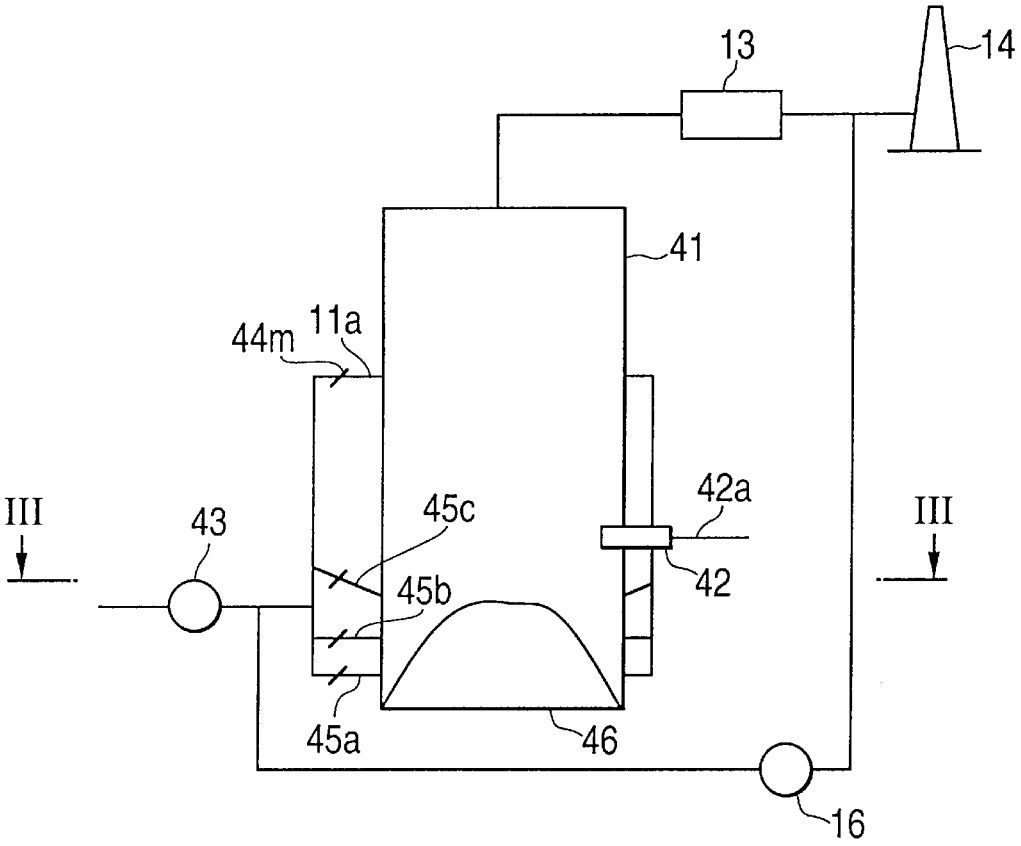
FIG. 2 is a schematic view of a recovery boiler of a second embodiment according to the present invention.
Figure 3:
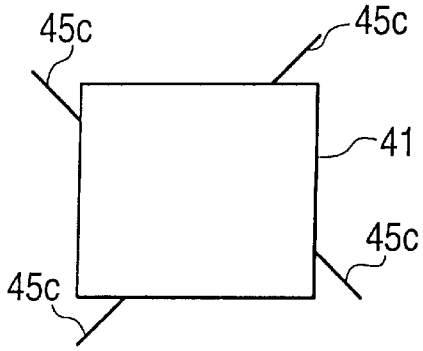
FIG. 3 is a cross sectional view taken on line III—III of FIG. 2.
Figure 4:
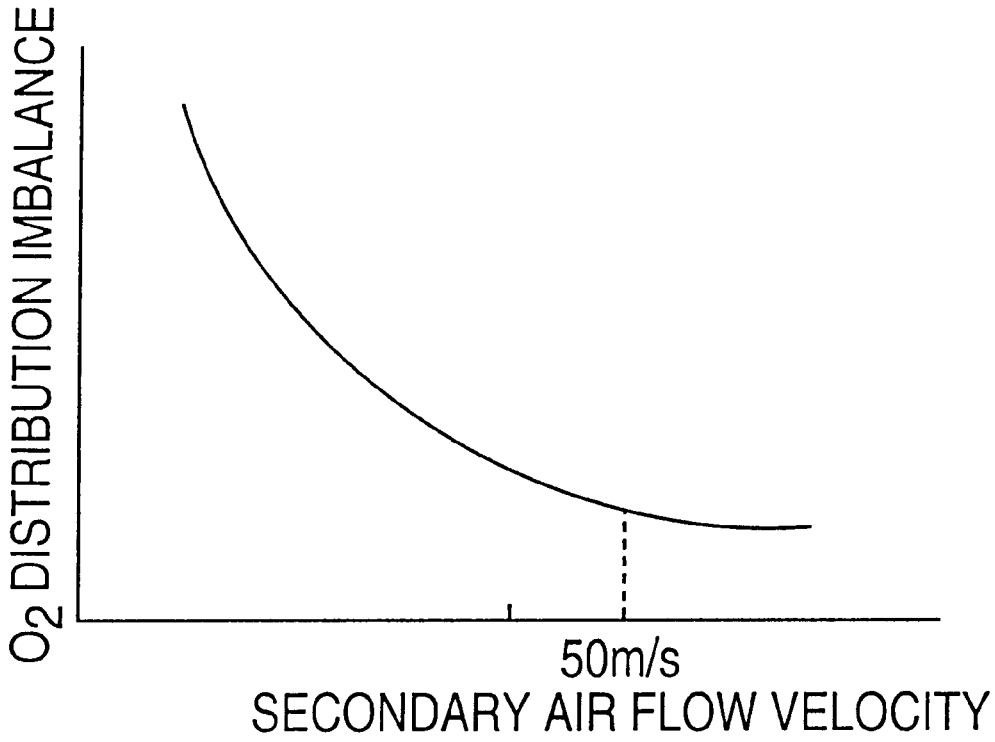
FIG. 4 is an explanatory graph showing a relation between secondary air flow velocity and an $O_2$ distribution imbalance of the recover boiler of FIG. 2.

Next, description is made on a second embodiment according to the present invention with reference to FIGS. 2 to 4. To be noted is that the same parts as those described for the prior art and the first embodiment are given the same numerals in the figures, and repeated description is omitted.

Combustion air from a fan 43 is fed from primary, secondary and tertiary air nozzles 45*a,* 45*b* and 45*c* of a main air supply, respectively, and from an additional air nozzle 11*a* via an air damper 44*m* at a furnace upper portion in the combustion air supply system. Total quantity of the air fed into the surroundings of a char bed 46 from the primary, the secondary and the tertiary air nozzles 45*a,* 45*b* and 45*c* is regulated to form an air ratio of 0.8 or less.

On the other hand, air fed from the primary air nozzle 45*a* is 40% or less of an entire combustion air quantity and the primary air nozzle 45*a* is of such a configuration and arrangement that an air flow velocity becomes 30 m/s or more. The char bed 46 is thereby prevented from coming nearer to a furnace side wall and thus a char bed configuration is always stabilized.

Air fed from the secondary air nozzle 45*b* is 40% or less of the entire combustion air quantity, and the secondary air nozzle 45*b* is of such a configuration and arrangement that the air flow velocity becomes 50 m/s or more. The air thereby reaches a furnace central portion and air distribution is homogenized. The relationship between air flow velocity from the secondary air nozzle 45*b* and an $O_2$ distribution imbalance is shown in FIG. 4.

Air fed from the tertiary air nozzle 45*c* is a portion of 20% or less of the entire combustion air quantity and is charged downwardly in the direction of the char bed 46, as shown in FIG. 2, and inclinedly from the vicinity of a furnace corner, as shown in FIG. 3. A swirling force is thereby generated and a carry-over of unburnt char is suppressed.

Further, a recirculated exhaust gas is mixed into the combustion gas or fed into the furnace directly by an exhaust gas recirculating fan 16, and thereby the above-mentioned functions and effects are further strengthened.

In summary, according to the present embodiment, the primary air is fed with a flow velocity of 30 m/s or more so that the char bed is prevented from coming nearer to the furnace side wall, and thereby a stable char bed configuration is formed and maintained.

Also, the secondary air, which is 40% or less of the entire combustion air, is fed with a flow velocity of 50 m/s or more so that it reaches the center portion of the furnace, and thereby air distribution in the furnace is homogenized.

Also, the tertiary air, which is a portion of 20% or less of the entire combustion air, is fed downwardly (toward the direction of the char bed 46) and inclinedly from the vicinity of the furnace corner so as to be given a swirling force, and thereby the unburnt char is prevented from being carried over toward the upper portion of the furnace.

Further, the exhaust gas is recirculated to be mixed into the combustion air and/or to be fed into the furnace directly, and thereby the functions and effects as mentioned above are further strengthened.

It is to be noted that the air flow velocities and quantities etc. of the primary, secondary and tertiary air are ones obtained by a multiplicity of experiments carried out repeatedly by the inventors here and found as preferable values as a result thereof.

Figure 5:
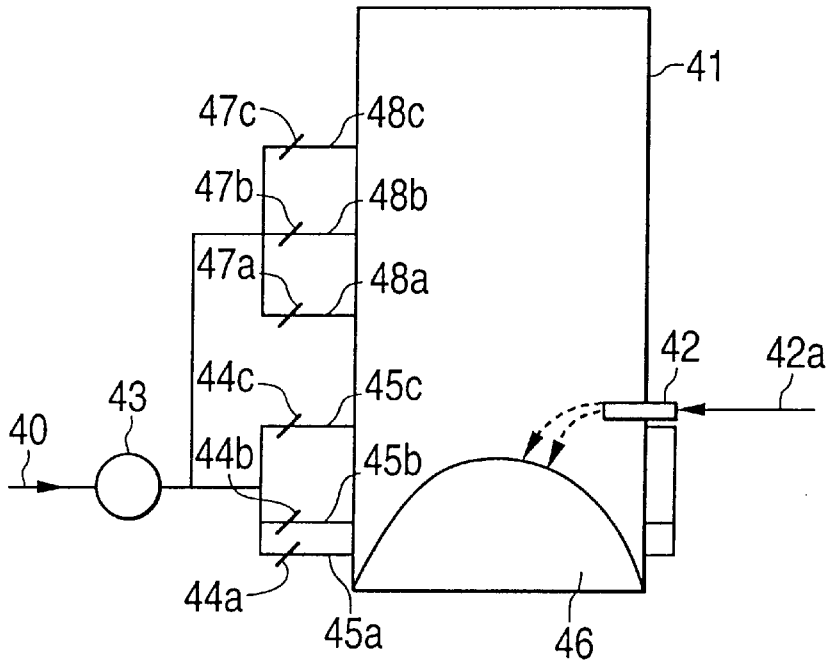
FIG. 5 is a schematic view of a recovery boiler of a third embodiment according to the present invention.

Next, a third embodiment according to the present invention is described with reference to FIGS. 5 to 7. To be noted is that the same parts as those in the prior art and in the first and second embodiments are given the same numerals and repeated description is omitted.

The present embodiment is different from the first and the second embodiments in that while in the first and second embodiments there is employed a so-called recirculated gas or inert gas feeding means by which a portion of the combustion gas exhausted from the recovery boiler is fed into the boiler from the furnace lower portion along the furnace side wall around the char bed and/or is fed into the duct for supplying the combustion air, no such means is employed in the third embodiment.

That is, in the present embodiment, out of the combustion air supplied from a fan 43, the air fed from a primary air nozzle 45*a* and a secondary air nozzle 45*b,* which together constitute a main air supply, and for a tertiary air nozzle 45*c,* which constitutes a first additional air supply, via air dampers 44*a,* 44*b* and 44*c* is regulated and fed so that an air ratio thereof in the surroundings of a char bed 46 becomes 0.8 or less. Remaining air is fed from quaternary air nozzles 48*a,* 48*b* and 48*c,* which constitute a second additional air supply, via air dampers 47*a,* 47*b* and 47*c.* The main air supply and first and second additional air supplies constitute a combustion air supply system.

It is to be noted that while an example where the air ratio in the surroundings of the char bed becomes 0.8 or less with respect to the combined air from the main air supply (the primary air nozzle 45*a* and the secondary air nozzle 45*b*) and from the first additional air supply (the tertiary air nozzle 45*c*) is described here, this air ratio may be 1.0 or less. While an optimum position of the second additional air supply (the quaternary air nozzle) is decided upon depending on a combustion reaction and a residence time of the furnace combustion gas, a number of steps of the position and the number of pieces of the nozzles, respectively, is not limited to three as shown in FIG. 5, but may be one or other plural numbers.

By the combustion air being so fed as mentioned above, there can be formed a combustion zone in the surroundings of the char bed 46 of reduction atmospheric field where the air ratio is 0.8 (or 1.0) or less, a combustion zone at an upper (downstream) portion thereof of reduction atmospheric field where the air ratio is 1.0 or less and unburnt components exist and a combustion zone at a further upper (downstream) portion thereof where the combustion completes. $NO_x$ reduction can thereby be attained.

According to the third embodiment as so constructed, in the combustion zone of the reduction atmospheric field where the air ratio is 0.8 (or 1.0) or less, there exists a surplus fuel beyond the chemical equivalent of oxygen, and a portion of the fuel forms a reduction atmospheric field which burns in a high temperature combustion atmosphere. Thus fuel and nitrogen (N) components in a black liquor and a nitrogen (N) component in the air present quite similar reactions as those described with respect to the reduction atmospheric field in the first embodiment. With respect to the subsequent combustion zone of reduction atmospheric field where the air ratio is 1.0 or less and unburnt components exist, and with respect to the combustion completion field also, quite similar reactions as those described in the combustion zone and the combustion completion field in the first embodiment take place.

Figure 6:
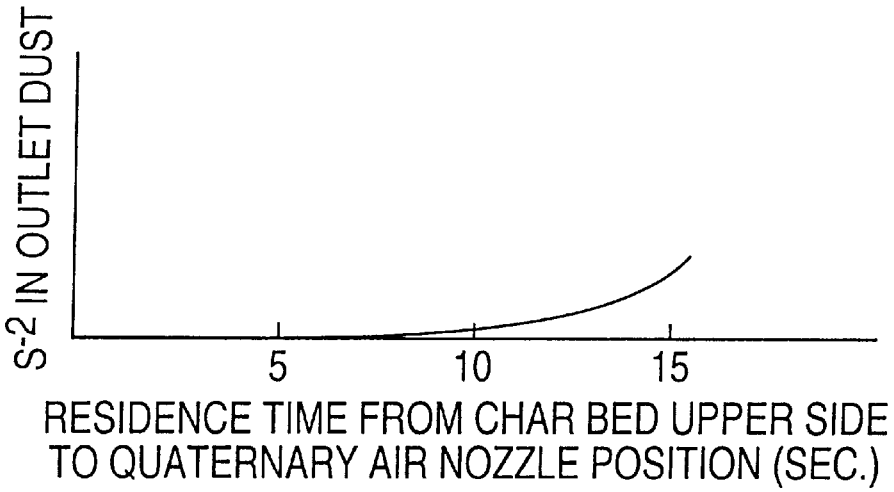
FIG. 6 is an explanatory graph showing changes of an $S^{-2}$ component corresponding to residence time from a char bed upper side to a quaternary air nozzle position of the recovery boiler of FIG. 5.
Figure 7:
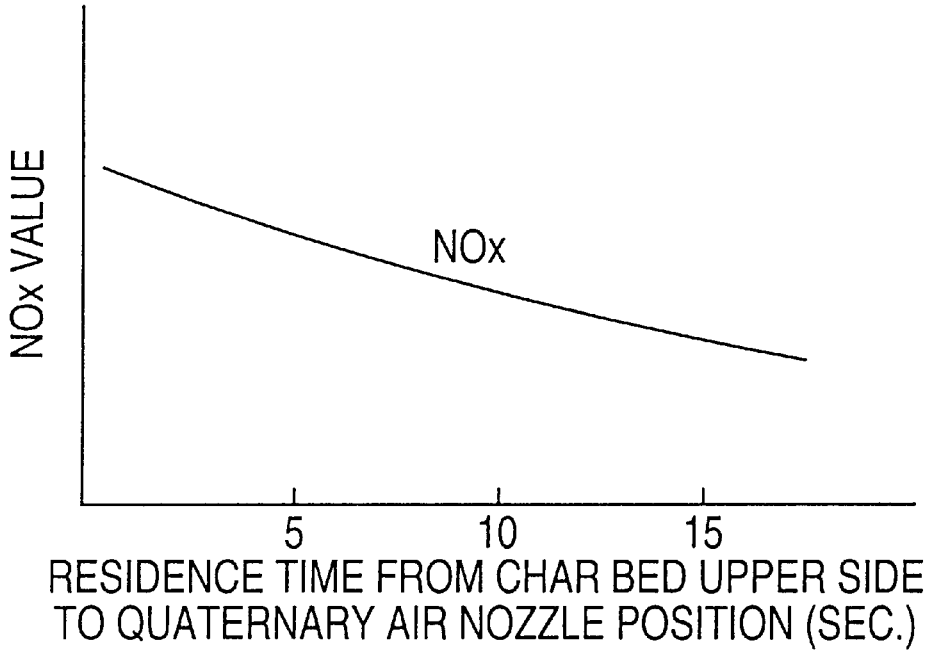
FIG. 7 is an explanatory graph showing changes of an $NO_x$ value corresponding to residence time from a char bed upper side to a quaternary air nozzle position of the recovery boiler of FIG. 5.
Figure 8:
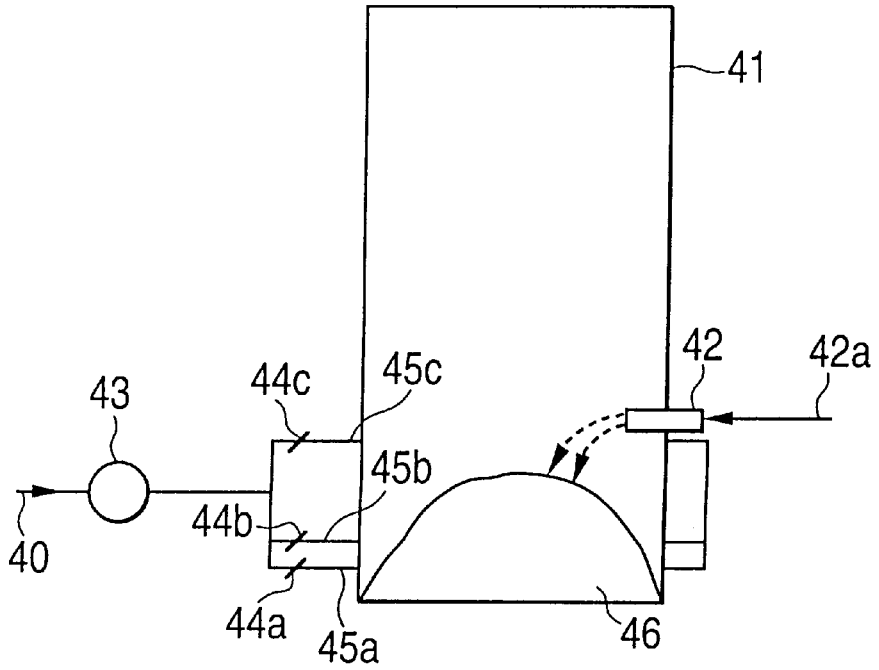
FIG. 8 (PRIOR ART)
FIG. 8 is a schematic view of a prior art recovery boiler.

As to a fitting position of the quaternary air nozzle, description is made with reference to FIGS. 6 and 7. If the position of the quaternary air nozzle is moved toward a combustion furnace outlet from the char bed upper side, the $NO_x$ value can be lowered. On the other hand, $S^{-2}$ in dust at the combustion furnace outlet (ash component) becomes observable. That is, as the position of the quaternary air nozzle comes nearer to the combustion furnace outlet, the length from a quaternary air feeding position to the combustion furnace outlet becomes shorter, and the residence time of the combustion exhaust gas becomes insufficient, so that unburnt $S^{-2}$ remains.

If the residence time from the char bed upper side to the quaternary air nozzle is secured for approximately 10 seconds, there is generated substantially no such unburnt $S^{-2}$, as shown in FIG. 6, and $NO_x$ reduction can be attained, as shown in FIG. 7. On the other hand, if the residence time from the quaternary air nozzle position to the combustion furnace outlet is to be secured sufficiently for approximately 10 seconds or more in order to attain complete combustion, the quaternary air nozzle position is to be set in a range of residence time of 5 seconds or more from the char bed upper side to the quaternary air nozzle and approximately 10 seconds from the quaternary air nozzle to the combustion furnace outlet. In the present embodiment, however, the quaternary air nozzle is set to a position in a range where the residence time to the combustion furnace outlet of 10 seconds or less and that from the char bed upper side of 5 to 10 seconds can be obtained.

In the above, the present invention has been described in reference to the embodiments shown in the figures but, needless to mention, the present invention is not limited thereto and may be added to with various modifications to its concrete construction within the scope of the claims as mentioned below.

According to the present invention, there are formed sequentially a combustion zone of reduction atmospheric field where the air ratio is 0.8 or less, a combustion zone of reduction atmospheric field where the air ratio is 1.0 or less and unburnt components exist and a combustion completion zone to complete the combustion. N content in the combustion air and fuel is thereby made innoxious, the combustion itself is stabilized and a reduction of the $NO_x$ generation quantity can be attained.

Also, an inert gas such as an exhaust gas etc. is fed along the furnace side wall from the recovery boiler lower portion, whereby direct contact of sulfide etc. and the surface of the furnace side wall is avoided and corrosion of the furnace side wall can be prevented.

According to the invention, the char bed can be prevented by the primary air from coming nearer to the furnace side wall so that blocking of the primary air nozzle is avoided and the char bed configuration becomes stabilized. Air quantity distribution in the surroundings of the char bed is homogenized by the secondary air and a carry-over of the unburnt char is suppressed by the tertiary air. Thus a stable combustion of the reduction atmospheric combustion field of the air ratio in the surroundings of the char bed of 0.8 or less can be secured and $NO_x$ reduction is attained.

According to the invention, the primary, secondary and tertiary air is fed with specific air flow velocity, air quantity, etc., whereby, stabilization of the char bed configuration, homogenization of the air quantity distribution in the surroundings of the char bed, etc., and formation of the reduction atmospheric combustion field of air ratio of 0.8 or less is secured, and a stable combustion and $NO_x$ reduction can be attained more securely.

According to the invention, there are generated a reduction atmospheric combustion field of air ratio of 0.8 or less formed by the main air nozzle, a downstream reduction atmospheric combustion field of air ratio of 1.0 or less formed by the fist additional air supply and a further downstream combustion completion field where shortage of the combustion air is made up by the second additional air supply, and thus a low $NO_x$ and a stable combustion can be attained.

According to the invention, there can be formed a reduction atmospheric combustion field of air ratio of 1.0 or less in combination of the main air supply and the first additional air supply without a specific correlation between each other. Downstream thereof, shortage of the combustion air is made up by the second additional air supply so that the combustion completes, and thereby $NO_x$ reduction and a stable combustion without remaining unburnt components etc. can be attained as a whole.

What is claimed is:

1. A recovery boiler comprising:

a furnace having a furnace bottom and a furnace side wall;

a burner for ejecting a black liquor into said furnace so as to form a char bed on said furnace bottom;

a combustion air supply system comprising:

a main air supply means for feeding air into said furnace so as to form a reduction atmospheric field with an air ratio of 0.8 or less surrounding the char bed formed on said furnace bottom, a first additional air supply means, disposed downstream of said main air supply means, for feeding air into said furnace so as to form a reduction atmospheric field where an air ratio of 1.0 or less and unburnt components exist, and a second additional air supply means, disposed downstream of said first additional air supply means, for feeding air so as to form a combustion zone where combustion completes; and a means for feeding one of a recirculated and an inert gas together with combustion air along said furnace side wall.

2. A recovery boiler comprising:

a furnace having a furnace bottom and a furnace side wall;

a burner for ejecting a black liquor into said furnace so as to form a char bed on said furnace bottom; and a combustion air supply system comprising:

a main air supply means for feeding air into said furnace so as to form a reduction atmospheric field with an air ratio of 0.8 or less surrounding the char bed formed on said furnace bottom, a first additional air supply means, disposed downstream of said main air supply means, for feeding air into said furnace so as to form a reduction atmospheric field where an air ratio of 1.0 or less and unburnt components exist, and a second additional air supply means, disposed downstream of said first additional air supply means, for feeding air so as to form a combustion zone where combustion completes.

* * * * *